United States Patent [19]

Toya

[11] Patent Number: 4,751,174

[45] Date of Patent: Jun. 14, 1988

[54] SILVER HALIDE PHOTOGRAPHIC MATERIAL WITH LIGHT-INSENSITIVE SILVER HALIDE EMULSION LAYER

[75] Inventor: Ichizo Toya, Kanagawa, Japan

[73] Assignee: Fuji Photo Film Co., Ltd., Kanagawa, Japan

[21] Appl. No.: 919,534

[22] Filed: Oct. 16, 1986

[30] Foreign Application Priority Data

Oct. 25, 1985 [JP] Japan ..... 60-239176

[51] Int. Cl.[4] ..... G03C 1/02; G03C 1/46; G03C 1/76

[52] U.S. Cl. ..... 430/502; 430/503; 430/504; 430/505; 430/506; 430/523; 430/581; 430/966

[58] Field of Search ..... 430/502, 503, 504, 505, 430/506, 581, 966, 523

[56] References Cited

U.S. PATENT DOCUMENTS 4,130,428 12/1978 Van Doorselaer ..... 430/139
4,347,301 8/1982 Kliem ..... 430/502 X
4,462,226 5/1984 Yamashita et al. ..... 430/502 X
4,513,079 4/1985 Sakanoue et al. ..... 430/502
4,543,323 9/1985 Iijima et al. ..... 430/505 X
4,640,890 2/1987 Fujita et al. ..... 430/505 X
4,652,515 3/1987 Ogawa et al. ..... 430/505

FOREIGN PATENT DOCUMENTS 821352 10/1959 United Kingdom .

*Primary Examiner*—Mukund J. Shah
*Attorney, Agent, or Firm*—Sughrue, Mion, Zinn, Macpeak, and Seas

[57] ABSTRACT

A silver halide photographic material is disclosed, comprising a support having provided thereon at least one light-sensitive silver halide emulsion layer and at least one substantially light-insensitive silver halide emulsion layer, wherein the substantially light-insensitive silver halide emulsion layer is present between a layer exhibiting the highest sensitivity among the light-sensitive silver halide emulsion layers and the support. This material is decreased in halation and cross-over light, and is excellent in sharpness.

8 Claims, No Drawings

SILVER HALIDE PHOTOGRAPHIC MATERIAL WITH LIGHT-INSENSITIVE SILVER HALIDE EMULSION LAYER

FIELD OF THE INVENTION

The present invention relates to a silver halide photographic material, and more particularly to a silver halide photographic material which is decreased in halation and cross-over light, and is excellent in sharpness.

BACKGROUND OF THE INVENTION

In general, the image quality of a silver halide photographic material is determined by sharpness and granularity. That is, higher sharpness and better granularity are the most important properties to be achieved for an image-recording material.

Silver halide photographic materials can be divided into two groups. One is a material such as the conventional light-sensitive materials for cameras in which a light-sensitive silver halide emulsion layer or layers are provided on only one side of a support, and the other is a material such as a direct medical X-ray film in which a light-sensitive silver halide emulsion layer or layers are provided on both sides of a support.

The important factor responsible for deterioration of the sharpness of a silver halide photographic material is halation, which involves the reaction (e.g., from the surface of the film support) of light which has passed through an emulsion layer back into the emulsion layer. In order to prevent this halation, an antihalation layer is usually provided in the light-sensitive materials for cameras.

Even in the direct medical X-ray films, so-called cross-over light (other than the halation) is another important factor tending to deteriorate sharpness. In order to decrease cross-over light, a layer similar to an antihalation layer can be provided, as disclosed in U.S. Pat. No. 4,130,428 and British Pat. No. 821,352. Heretofore, as a layer for use for the above purpose, a method of using an immobile mordant and a dye has been known. This method, however, produces various problems, such as a reduction in photographic sensitivity and an increase in the fog level, due to the transfer to adjacent layers of such dyes and mordant at the time of coating or during storage.

SUMMARY OF THE INVENTION

The present invention is intended to overcome the above problems, and thus an object of the present invention is to provide a method whereby both the halation and cross-over light can be prevented or at least decreased without causing a reduction in photographic sensitivity and an increase in fog level during the time of storage.

It has been found that the object can be attained by providing a silver halide emulsion layer having substantially no photographic sensitivity, hereinafter referred to as a substantially light-insensitive emulsion layer, (e.g, having a sensitivity which is not more than 1/100, and preferably not more than 1/1,000 of that of a photographic emulsion layer which is highest in sensitivity, i.e., of the highest sensitivity) between a light-sensitive silver halide emulsion layer exhibiting the highest sensitivity and a support in silver halide photographic materials comprising a support and at least one light-sensitive silver halide emulsion layers on the support.

The present invention relates to a silver halide photographic material comprising a support having provided thereon at least one light-sensitive silver halide emulsion layer and at least one substantially light-insensitive silver halide emulsion layer, wherein the substantially light-insensitive silver halide emulsion layer is present between a layer exhibiting the highest sensitivity among the light-sensitive silver halide emulsion layers and the support.

DETAILED DESCRIPTION OF THE INVENTION

In accordance with the present invention, in the case of a light-sensitive material, such as conventional light-sensitive materials for cameras, in which a light-sensitive silver halide emulsion layer is provided only on one side of a support, the halation phenomenon occurring at the interface between the emulsion and the base, and between the base and the air is minimized and thus high sharpness can be ensured. On the other hand, in the case of a light-sensitive material, such as a medical X-ray film, in which a light-sensitive emulsion layer is provided on both sides of a support, the so-called cross-over light is markedly decreased and thus high sharpness can be obtained.

Examples of silver halide light-sensitive materials in accordance with the present invention are described below:

(i) A silver halide light-sensitive material comprising
a support,
a silver halide emulsion layer having substantially no sensitivity, hereinafter referred to as a substantially light-insensitive emulsion layer provided on one side of the support, a light-sensitive silver halide emulsion layer provided on the substantially light-insensitive emulsion layer, a protective layer provided on the light-sensitive emulsion layer, and
a back layer provided on the other side of the support.

(iii) A silver halide light-sensitive material comprising
a support,
a substantially light-insensitive silver halide emulsion layer provided on one side of the support, a light-sensitive silver halide emulsion layer provided on the substantially light-insensitive emulsion layer, a silver halide emulsion layer having the highest sensitivity provided on the above light-sensitive emulsion layer, a surface protective layer provided on the emulsion layer of the highest sensitivity, and
a back layer provided on the other side of the support.

(iii) A silver halide light-sensitive material comprising
a support and
the emulsion layer and surface protective layer as described in (i) or (ii) above provided on both sides of the support.

In a preferred embodiment of the present invention, the substantially light-insensitive silver halide emulsion layer is the lowermost layer of the silver halide emulsion layers.

In the substantially light-insensitive silver halide emulsion layer, the amount of silver coated is preferably from 0.01 to 5 g/m$^2$, and more preferably from 0.1 to 3 g/m$^2$ per layer on one side of the support. Similarly, in the light-sensitive silver halide emulsion layer which substantially has the sensitivity, the amount of silver coated is preferably from 0.1 to 15 g/m$^2$, and particularly preferably from 0.5 to 10 g/m$^2$ per layer.

The silver halide photographic material of the present invention may further have an interlayer, a filter layer, and so forth, if desired.

Silver halide grains in the photographic emulsion used in the photographic material of the present invention may have a regular form crystal, such as a cubic form and an octahedral form, or an irregular form crystal, such as a spherical form and a tabular form, or a composite form crystal thereof. Silver halide grains having various crystal forms can be used. In addition, tabular silver halide grains having an aspect ratio (diameter/thickness) of not less than 5, as described in *Research Disclosure,* Vol. 225, pp. 20–58 (January, 1983) can be used.

These photographic emulsions can be prepared by the methods described, for example, in R. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of the acidic method, the neutral method, the ammonia method, and so forth can be used. As a method of reacting a soluble silver salt and a soluble halide, any of the single jet method, the double jet method, a combination thereof, and so forth can be employed.

In preparation of these photographic emulsions, any combinations of silver chloride, silver bromide, silver iodide, silver chlorobromide, silver iodobromide, silver chloroiodobromide, and silver chloroiodide can be employed. Particles in the two emulsion layers may be the same or different.

Cadmium salts, zinc salts, lead salts, thallium salts, iridium salts or complex salts thereof, rhodium salts or complex salts thereof, iron salts or complex salts thereof, and so forth may be allowed to be present at the process of grain formation or physical ripening of silver halide grains, as described in G. F. Duffin, *Photographic Emulsion Chemistry,* The Forcal Press (1966).

The substantially light-insensitive silver halide emulsion of the present invention has a sensitivity (i.e., a sensitivity which substantially has no influence on the image formation of the light-sensitive material) which is not more than 1/100th, and preferably not more than 1/1,000th of the sensitivity of a layer having the highest sensitivity. Such substantially light-insensitive emulsions can be prepared by known desensitization techniques such as a method of preparation in which chemical sensitization is not applied, a method in which a densensitizing agent, such as rhodium and pinacryptol yellow, is added, a method in which a large amount of a sensitizing dye is adsorbed on the surface of silver halide grains, a method in which an internal latent image type emulsion can be used, and combinations thereof.

In particular, as silver halide for the substantially light-insensitive silver halide emulsion layer, particles having a high fixing speed such as silver halide particles containing a large amount of silver chloride, finely divided silver halide particles, or tabular silver halide particles having a large surface area, or particles with a sensitizing dye adsorbed thereon can be preferably used.

Binders which can be used as a binder for the emulsion layers and other layers include proteins such as gelatin and casein; cellulose compounds such as carboxymethyl cellulose and hydroxyethyl cellulose; sugar derivatives such as agar, dextran, sodium alginate, and starch derivatives; synthetic hydrophilic colloids, such as polyvinyl alcohol, poly-N-vinyl pyrrolidone, acrylic acid copolymers, polyacrylamide, or derivatives thereof and partially hydrolysis products; and so on.

The above gelatin includes so-called lime-processed gelatin, acid-processed gelatin, and enzyme-processed gelatin.

The photographic material of the present invention can contain alkyl acrylate-based latexes as described in U.S. Pat. Nos. 3,411,911, 3,411,912, and 3,525,620 in its constituent layers.

An emulsion for use in the light-sensitive silver halide emulsion layer of the present invention is preferably subjected to chemical sensitization.

For this chemical sensitization, the methods described in the above cited references by Glafkides and Zelikman et al., and H. Frieser ed., *Die Grundlagen der Photographischen Prozesse mit Silberhalogeniden,* Akademische Verlagsgesellschaft (1968) can be used.

That is, the sulfur sensitization method using sulfur containing compounds capable of reacting with silver ions or active gelatin, the reduction sensitizing method using a reducing substance, the noble metal sensitization method using noble metal (e.g., gold) compounds, and so forth can be used alone or in combination with each other. Sulfur sensitizing agents which can be used include thiosulfuric acid salts, thioureas, thiazoles, rhodanines, and other compounds. Representative examples of these compounds are described in U.S. Pat. Nos. 1,574,944, 2,410,689, 2,278,947, 2,728,668, and 3,656,955. Reduction sensitizing agents which can be used include stannous salts, amines, hydrazine derivatives, formamidinesulfinic acid, and silane compounds. Representative examples of these compounds are described in U.S. Pat. Nos. 2,487,850, 2,419,974, 2,518,698, 2,983,609, 2,983,610, and 2,694,637. For noble metal sensitization, as well as gold complex salts, the complex salts of Group VIII metals of the periodic table, such as platinum, iridium, and palladium can be used. Representative examples of these compounds are described in U.S. Pat. Nos. 2,399,083 and 2,448,060 and British Pat. No. 618,061.

In the light-sensitive material of the present invention, various compounds can be incorporated as stabilizers. That is, a number of compounds known as stabilizers, for example, azoles such as benzothiazolium salts, nitroindazoles, triazoles, benzotriazoles, and benzimidazoles (particularly nitro- or halogen-substituted products); heterocyclic mercapto compounds, such as mercaptothiazoles, mercaptobenzothiazoles, mercaptobenzimidazoles, mercaptothiadiazoles, mercaptotetrazoles (particularly 1-phenyl-5-mercaptotetrazole), and mercaptopyridines; the above heterocyclic mercapto compounds further containing a water soluble group, e.g., a carboxyl group and a sulfone group; thioketo compounds such as oxazolinethione; azaindenes such as tetraazaindenes (particularly 4-hydroxy substituted (1,3,3a,7)tetraazaindenes; benzenethiosulfonic acids; and benzenesulfinic acid can be added.

The photographic emulsion layers or other constituent layers of the light-sensitive material of the present invention may further contain surface active agents for various purposes, for example, as coating aids, as antistatic agents, for improvement of sliding properties, as emulsification or dispersion, for prevention of adhesion, for improvement of photographic properties (e.g., acceleration of development, increasing contrast, and increasing sensitivity), and the like.

Surface active agents which can be used for the above purposes are described below.

Nonionic surface active agents, such as saponin (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamide or amides, and the polyethylene oxide adducts of silicone), glycidol derivatives (e.g., alkenylsuccinic acid polyglyceride and alkylphenol polyglyceride), polyhydric alcohol fatty acid esters, and the alkyl esters of sugar;

anionic surface active agents containing an acidic group, such as a carboxyl group, a sulfo group, a phospho group, a sulfuric acid ester group, and a phosphoric acid ester group, for example, alkylcarboxylic acid salts, alkylsulfonic acid salts, alkylbenzenesulfonic acid, alkylnaphthalenesulfonic acid salts, alkylsulfuric acid esters, alkylphosphoric acid esters, N-acyl-N-alkyltauric acid, sulfosuccinic acid esters, sulfoalkylpolyoxyethylene alkylphenyl esters, and polyoxyethylenealkylphosphoric acid esters;

amphoteric surface active agents such as amino acids, aminoalkylsulfonic acids, aminoalkylsulfuric acid or phosphoric acid esters, alkylbetains and amine oxides; and cationic surface active agents such as alkylamines, aliphatic or aromatic quaternary ammonium salts, heterocyclic quaternary ammonium salts (e.g., pyridinium and imidazolium), and aliphatic or heterocyclic ring-containing phosphonium or sulfonium salts.

Particularly preferred are fluorine-containing surface active agents as described in Japanese Patent Application (OPI) No. 80849/85 (the term "OPI" as used herein means a "published unexamined Japanese patent application") and polyalkylene oxide group-containing surface active agents.

The photographic emulsions (i.e., light-sensitive or substantially light-insensitive emulsions) of the present invention can be subjected to spectral sensitization using methine dyes and so on. Preferably, the difference between the absorption maximums due to dyes in the light-sensitive emulsions and the substantially light-insensitive emulsions is within 20 nm. Further, it is preferred that the same dye be used in both the light-sensitive emulsion and the substantially light-insensitive emulsion. Dyes which can be used include cyanine dyes, merocyanine dyes, composite cyanine dyes, composite merocyanine dyes, holo-polar cyanine dyes, hemicyanine dyes, styryl dyes, and hemioxonol dyes. Particularly useful dyes are those belonging to the cyanine dyes, merocyanine dyes, and composite merocyanine dyes. To these dyes, any nuclei commonly utilized in cyanine dyes as basic heterocyclic nuclei can be applied. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; nuclei resulting from the fusion of the above nuclei and alicyclic hydrocarbon rings; nuclei resulting from the fusion of the above nuclei and aromatic hydrocarbon rings; i.e., an indolenine nucleus, a benzindolenine nucleus, an indole nucleus, a benzoxazole nucleus, a naphthooxazole nucleus, a benzothiazole nucleus, a naphthothiazole nucleus, a benzoselenazole nucleus, a benzimidazole nucleus, a quinoline nucleus, and so on can be applied. These nuclei may be substituted in its carbon atom.

In merocyanine dyes or composite merocyanine dyes, as nuclei having the ketomethylene structure, 5- and 6-membered heterocyclic nuclei such as a pyrazoline-5-one nucleus, a thiahydantoin nucleus, a 2-thiooxazolidine-2,4-dione nucleus, a thiazolidine-2,4-dione nucleus, a rhodanine nucleus, and a thiobarbituric acid nucleus can be applied.

Typical examples of useful sensitizing dyes are shown below.

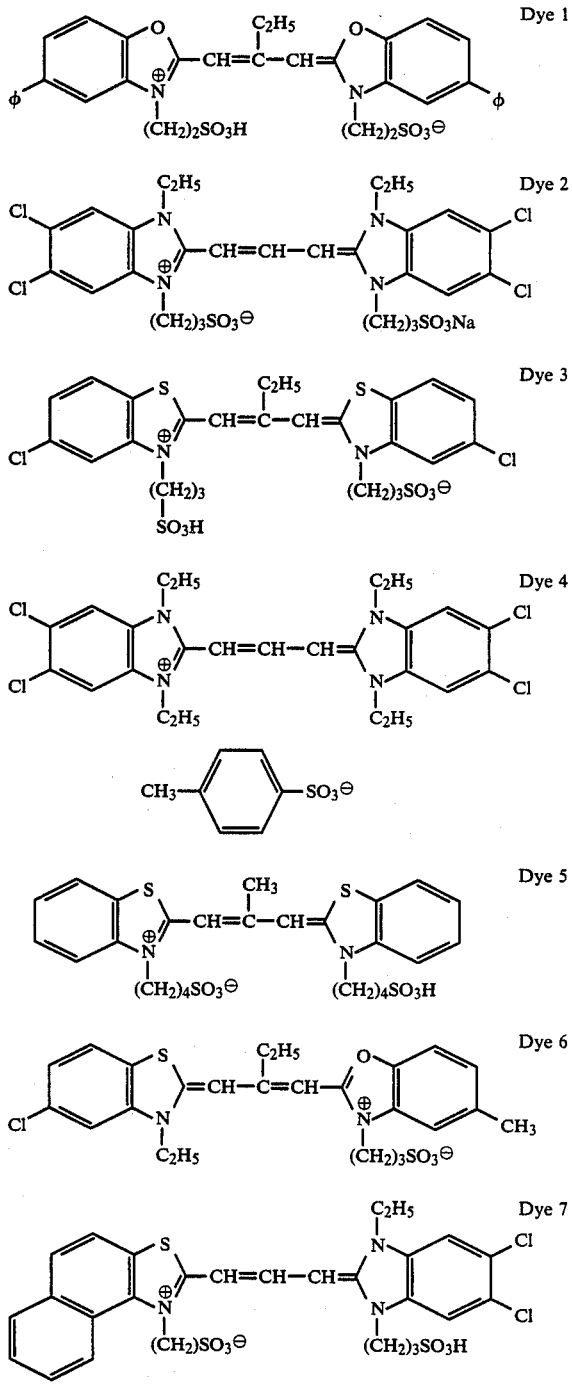

-continued

Dye 8

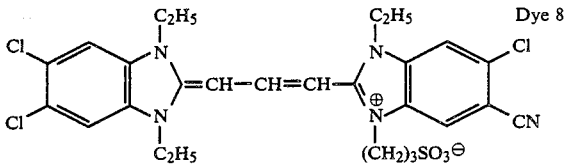

Dye 9

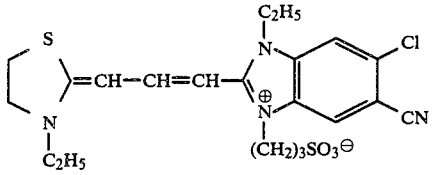

Dye 10

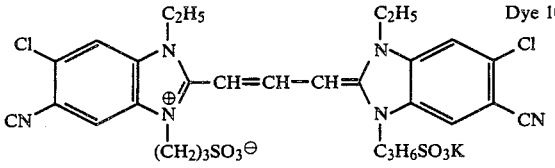

Dye 11

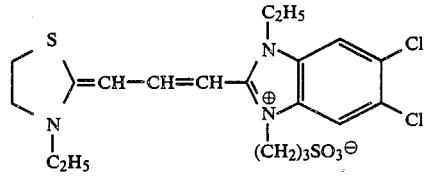

Dye 12

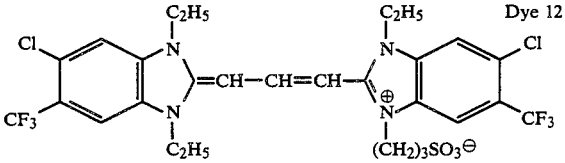

Dye 13

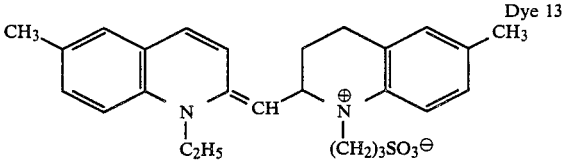

Dye 14

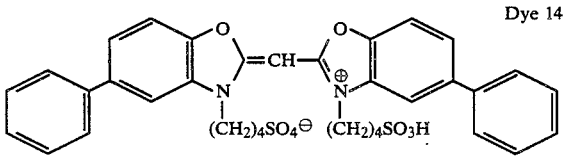

Dye 15

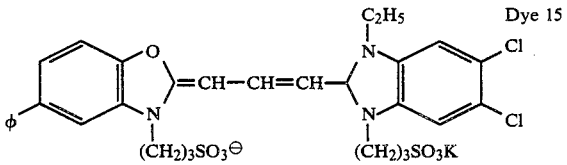

Dye 16

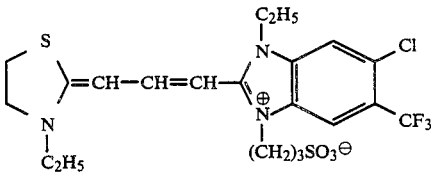

-continued

Dye 17

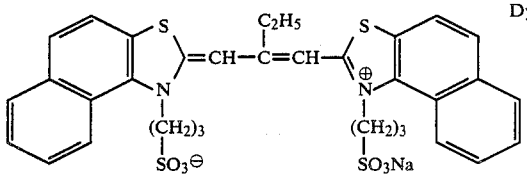

Dye 18

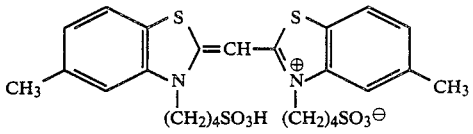

Dye 19

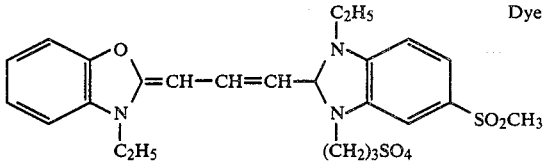

Dye 20

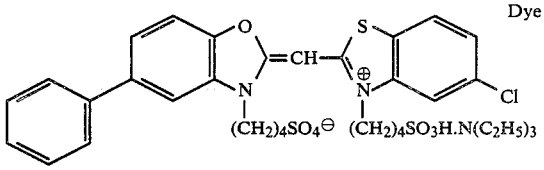

Dye 21

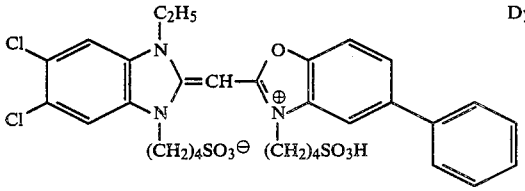

Dye 22

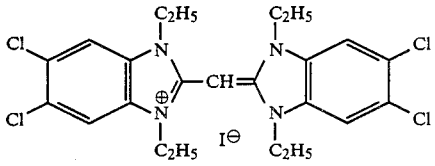

Dye 23

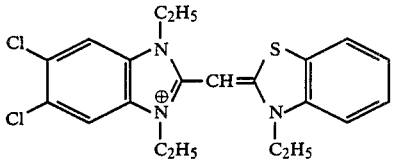

In the light-sensitive silver halide emulsion layer and the substantially light-insensitive silver halide emulsion layer of the present invention, the amount of the sensitizing dye used is preferably from $1\times10^{-6}$ to $5\times10^{-3}$ mol, and more preferably from $1\times10^{-5}$ to $5\times10^{-3}$ mol, per mol of silver. In the substantially light-insensitive silver halide emulsion layer, the sensitizing dye is preferably used in an amount equal to 10 times that of the light-sensitive layer.

The photographic emulsion of the present invention may contain a compound capable of forming a dye on reacting with an oxidized product of an aromatic amine (usually a primary amine) developing agent (this compound is hereinafter referred to as a "coupler"). As the coupler, non-diffusing coupler having a hydrophobic group called a ballast group in the molecule is preferred. The coupler may be 4-equivalent or 2-equivalent relative to the silver ion. The photographic emulsion may contain a colored coupler having the effect of color correction or a coupler releasing a development inhibitor with the occurrence of development (so-called DIR coupler). The coupler may be a coupler producing a colorless product through the coupling reaction.

As the yellow color-forming coupler, known open chain ketomethylene-based couplers can be used. Of these compounds, benzoylacetoanilide- and pyvaloylacetoanilide-based compounds are advantageous to use.

Magenta couplers which can be used include pyrazolone compounds, indazolone compounds, and cyanoacetyl compounds. It is particularly advantageous to use pyrazolone compounds.

Cyan couplers which can be used include phenol compounds and naphthol compounds.

A protective layer of the silver halide photographic material of the present invention is a layer of hydrophilic colloid. As these hydrophilic colloids, the ones described above can be used. The protective layer may be a single layer or may be of the multi-layer structure.

The silver halide photographic material of the present invention may contain a matting agent and/or a lubricant in its emulsion layer or protective layer, preferably in its protective layer. Preferred examples of such matting agents are organic compounds such as water dispersible vinyl polymers (e.g., polymethyl methacrylate) and inorganic compounds such as silver halide and strontium barium sulfate, all having a particle diameter of from 0.3 to 5 μm or at least twice, preferably at least four times the thickness of the protective layer. The lubricant is effective in preventing the adhesion problem, like the matting agent, and is particularly effective in improving friction characteristics associated with camera suitability at the time of photographing or projecting movie films. Representative examples of such lubricants are waxes such as liquid paraffin and higher fatty acid esters, polyfluorinated hydrocarbons or their derivatives, and silicones such as polyalkylpolysiloxane, polyarylpolysiloxane, polyalkylarylpolysiloxane, or their alkylene oxide adducts.

In the silver halide photographic material of the present invention, if desired, other layers such as an interlayer, a filter layer, and the like can be provided.

Typical examples of the silver halide photographic material of the present invention include an X-ray light-sensitive material, a lith light-sensitive material, a black-and-white photographic light-sensitive material, a color negative light-sensitive material, a color reversal light-sensitive material, and a color printing paper. A preferred example is a negative light-sensitive material.

In the silver halide photographic material of the present invention, if desired, various additives can be added. For example, a development accelerator, a brightening agent, an anti-color foggant, and an ultraviolet absorber can be used. Representatively, the compounds described in *Research Disclosure,* No. 176, RD No. 17643, pp. 28–30 (December, 1978) can be used.

The present invention is described in greater detail with reference to the following examples, although the present invention is not limited thereto.

EXAMPLE 1

(1) Preparation of Light-Sensitive Silver Halide Emulsion

Potassium bromide, potassium iodide, and silver nitrate were added to an aqueous gelatin solution with vigorous stirring to prepare a silver iodobromide emulsion (AgI=3 mol%) containing thick tabular grains having an average grain diameter of 1.2 μm. This emulsion was separated by the usual precipitation method, and was washed with water and then was subjected to chemical sensitization according to the gold/sulfur sensitization method using chloroauric acid and sodium thiosulfate. Then 4-hydroxy-6-methyl-1,3,3a,7-tetraazaindene as a stabilizer was added to obtain a light-sensitive silver iodobromide emulsion (A).

A light-sensitive silver iodobromide emulsion (B) was prepared in the same manner as above except that chemical sensitization was not applied.

In addition, a silver iodobromide emulsion containing thin tabular grains (aspect ratio=10) having the same silver iodide content (AgI=3 mol%) and having an average grain diameter of 1.2 μm was prepared, and then the same stabilizer as above was added without chemical sensitization to prepare a light-sensitive silver iodobromide emulsion (C).

(2) Preparation of Coated Sample

Layers having the formulations as shown below were coated on a triacetyl cellulose support in the order shown below to prepare Samples 1 to 9.

In each layer of each sample, emulsions, and sensitizing dyes shown in Table 1 were incorporated.

| | |
|---|---|
| (Emulsion Layer 1) | |
| Binder: gelatin | 8.5 g/m$^2$ |
| Amount of silver coated | 3.9 g/m$^2$ |
| Coating aids: sodium dodecylbenzenesulfonate | 0.1 mg/m$^2$ |
| poly-p-styrenesulfonic acid potassium salt | 1 mg/m$^2$ |
| (Surface Protective Layer) | |
| Binder: gelatin | 0.7 g/m$^2$ |
| Coating aid: sodium N—oleoyl-N—methyltaurate | 0.2 mg/m$^2$ |
| Matting agent: finely divided polymethylmethacrylate (average grain size: 3 μm) | 0.13 mg/m$^2$ |

Sensitizing Dye A

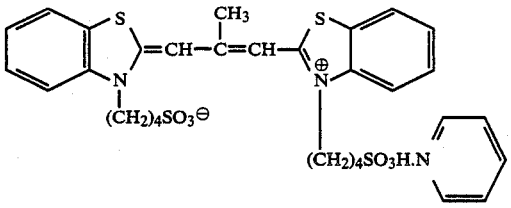

(3) Sensitometry

Each sample was stored under conditions of 25° C. and 65% RH for 7 days after coating. The sample was exposed through an optical wedge for 1/10 second by the use of a 400 lux tungsten lamp and then developed at 20° C. for 7 minutes using a developer having the formulation shown below. After fixing, washing with water and drying, each sample was measured for photographic sensitivity at a predetermined density (optical density of 0.1) higher than the fog density according to the same method. The results are shown in Table 1.

| | |
|---|---|
| (Developer) | |
| Metol (p-methylaminophenol sulfate) | 2 g |
| Sodium sulfite | 100 g |
| Hydroquinone | 5 g |
| Borax.10 $H_2O$ | 2 g |

-continued

| | |
|---|---|
| Water to make | 1,000 ml |
| (Fixing Solution) | |
| Ammonium thiosulfate | 200.0 g |
| Sodium sulfite (anhydrous) | 20.0 g |
| Boric acid | 8.0 g |
| Disodium ethylenediaminetetraacetate | 0.1 g |
| Aluminum sulfate | 15.0 g |
| Sulfuric acid (18 N) | 2.0 g |
| Glacial acetic acid | 22.0 g |
| Water to make | 1,000 ml |
| (The pH was adjusted to 4.2.) | |

TABLE 1

| Sample | Emulsion | Sensitizing Dye A (mg/m$^2$) | Sensitivity |
|---|---|---|---|
| 1 | (A) | — | 100 |
| 2 | (A) | 3.2 | 142 |
| 3 | (A) | 6.4 | 196 |
| 4 | (B) | — | 0.1 or less |
| 5 | (B) | 3.2 | 0.1 or less |
| 6 | (B) | 6.4 | 0.1 or less |
| 7 | (C) | — | 0.1 |
| 8 | (C) | 3.2 | 0.1 |
| 9 | (C) | 6.4 | 0.2 |

EXAMPLE 2

Using Emulsions (A), (B), and (C) as prepared above, coated samples were prepared as follows.

1. Preparation of Coated Sample

Layers having the formulations shown below were provided on a triacetyl cellulose support in the order shown below to prepare a sample.

In each layer of each sample, emulsions shown in Table 2 were incorporated.

| | |
|---|---|
| (Emulsion Layer 1) | |
| Emulsion (B) or (C) | |
| Sensitizing dye A | 6.4 mg/m$^2$ |
| Binder: gelatin | 8.5 g/m$^2$ |
| Amount of silver coated | 3.9 g/m$^2$ |
| Coating aids: | |
| sodium dodecylbenzenesulfonate | 0.1 mg/m$^2$ |
| poly-p-styrenesulfonic acid potassium salt | 1 mg/m$^2$ |
| (Emulsion Layer 2) | |
| Emulsion (A) | |
| Binder: gelatin | 8.5 g/m$^2$ |
| Amount of silver coated | 3.9 g/m$^2$ |
| Coating aids: | |
| sodium dodecylbenzenesulfonate | 0.1 mg/m$^2$ |
| poly-p-styrenesulfonic acid potassium salt | 1 mg/m$^2$ |
| (Surface Protective Layer) | |
| Binder: gelatin | 0.7 g/m$^2$ |
| Coating aid: sodium N—oleoyl-N—methyltaurate | 0.2 g/m$^2$ |
| Matting agent: finely divided polymethylmethacrylate (average particle size: 3 μm) | 0.13 mg/m$^2$ |

(3) Sensitometry

Same as in Example 1.

(4) Measurement of MTF (modulation transfer function)

MTF was measured with an aperture of 400×2 μ$^2$. The evaluation was determined at a space frequency at which the MTF value was 0.5. MTF is described in T. H. James ed., *The Theory of the Photographic Process*, 4th Ed., Macmillan (1977), pp. 592–618.

TABLE 2

| Sample | Emulsion Layer 1 | Sensitivity | MTF 0.5 lines/mm |
|---|---|---|---|
| 10 | Emulsion (B) | 98 | 30.5 |
| 11 | Emulsion (C) | 99 | 41 |
| Comparative Sample 1 | — | 100 | 20 |
| Comparative Sample 2 | — | 62 | 26 |

In the samples of the present invention, the loss of sensitivity is small and MTF is improved as compared to the Comparative Samples.

Comparative Sample 1 was prepared by coating Emulsion Layer 2 directly on the triacetyl cellulose support and additionally the surface protective layer on Emulsion Layer 2.

Comparative Sample 2 was prepared in the same manner as in the preparation of Sample 10 except that an antihalation layer having the formulation shown below was used in place of Emulsion Layer 1.

(Antihalation Layer) 0.7 mg/m$^2$

Mordanting agent:

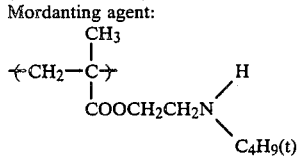

hydrochloric acid salt

Gelatin 2.1 g/m$^2$

Dye: 0.07 g/m$^2$

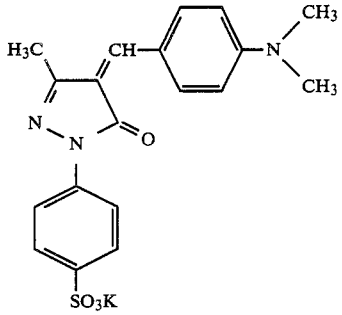

As is apparent from the results of Table 2, Samples 10 and 11 of the present invention are substantially free from a reduction in sensitivity, and are significantly improved in sharpness.

While the invention has been described in detail and with reference to specific embodiments thereof, it will be apparent to one skilled in the art that various changes and modifications can be made therein without departing from the spirit and scope thereof.

What is claimed is:

1. A black-and-white silver halide photographic material comprising a support having provided thereon at least one light-sensitive silver halide emulsion layer, and at least one substantially light-insensitive silver halide emulsion layer, wherein the substantially light-insensitive silver halide emulsion layer is located nearer to the support than any of the light sensitive silver halide emulsions layers.

2. A silver halide photographic material as in claim 1, wherein the sensitivity of the substantially light-insensitive silver halide emulsion layer is not more than 1/1,000th of the sensitivity of the layer having the highest sensitivity among the light-sensitive silver halide emulsion layers.

3. A silver halide photographic material as in claim 1, wherein the amount of silver coated in the substantially light-insensitive silver halide emulsion layer is from 0.01 to 5 $g/m^2$, and the amount of silver coated in the light-sensitive silver halide emulsion layer which substantially has the sensitivity is from 0.1 to 15 $g/m^2$.

4. A silver halide photographic material as in claim 2, wherein the amount of silver coated in the substantially light-insensitive silver halide emulsion layer is from 0.01 to 5 $g/m^2$, and the amount of silver coated in the light-sensitive silver halide emulsion layer which substantially has the sensitivity is from 0.1 to 15 $g/m^2$.

5. A silver halide photographic material as in claim 1, wherein the amount of silver coated in the substantially light-insensitive silver halide emulsion layer is from 0.1 to 3 $g/m^2$, and the amount of silver coated in the light-sensitive silver halide emulsion layer which substantially has the sensitivity is from 0.5 to 10 $g/m^2$.

6. A silver halide photographic material as in claim 2, wherein the amount of silver coated in the substantially light-insensitive silver halide emulsion layer is from 0.1 to 3 $g/m^2$, and the amount of silver coated in the light-sensitive silver halide emulsion layer which substantially has the sensitivity is from 0.5 to 10 $g/m^2$.

7. A silver halide photographic material as in claim 1, wherein photographic emulsions for forming the light-sensitive silver halide emulsion layer or the substantially light-insensitive silver halide emulsion layer are subjected to spectral sensitization using methine dyes.

8. A silver halide photographic material as in claim 7, wherein a difference between absorption maximums due to the dyes in the light-sensitive emulsions and the substantially light-insensitive emulsions is within 20 nm.

* * * * *